US010576484B2

(12) United States Patent
Toyota

(10) Patent No.: US 10,576,484 B2
(45) Date of Patent: Mar. 3, 2020

(54) AXIAL FEED PLASMA SPRAYING DEVICE

(75) Inventor: Kenzo Toyota, Tokyo (JP)

(73) Assignee: Shinwa Industry Co., Ltd. (JP)

( * ) Notice: Subject to any disclaimer, the term of this patent is extended or adjusted under 35 U.S.C. 154(b) by 787 days.

(21) Appl. No.: 14/130,608

(22) PCT Filed: Jun. 7, 2012

(86) PCT No.: PCT/JP2012/064636

§ 371 (c)(1),
(2), (4) Date: Jan. 2, 2014

(87) PCT Pub. No.: WO2013/008563

PCT Pub. Date: Jan. 17, 2013

(65) Prior Publication Data

US 2014/0144888 A1 May 29, 2014

(30) Foreign Application Priority Data

Jul. 12, 2011 (JP) ..... 2011-153415

(51) Int. Cl.
*B05B 7/22* (2006.01)
*H05H 1/42* (2006.01)
(Continued)

(52) U.S. Cl.
CPC ..... *B05B 7/226* (2013.01); *C23C 4/134* (2016.01); *H05H 1/42* (2013.01); *H05H 1/44* (2013.01)

(58) Field of Classification Search
CPC ..... B05B 7/226; C23C 4/134; H05H 1/42; H05H 1/44
USPC ..... 219/121.5, 121.47, 121.48, 121.51, 219/121.52, 121.55, 76.16, 76.15; 427/569, 576
See application file for complete search history.

(56) References Cited

U.S. PATENT DOCUMENTS 5,008,511 A * 4/1991 Ross ..... H05H 1/44 219/121.47
5,144,110 A * 9/1992 Marantz ..... H05H 1/44 219/121.47
(Continued)

FOREIGN PATENT DOCUMENTS

JP 60-129156 7/1985
JP 63-40300 2/1988
(Continued)

*Primary Examiner* — Ibrahime A Abraham
*Assistant Examiner* — Biniam B Asmelash
(74) *Attorney, Agent, or Firm* — Price Heneveld LLP

(57) ABSTRACT

A spray coating apparatus includes a cathode and an anode nozzle to form a pair. A front end of the anode nozzle is provided with three or more plasma jet jetting holes, and a spray material jetting hole is disposed at the center of an area surrounded by the plasma jet jetting holes. The spray material jetted through the jetting hole is fed into the center axis of a complex plasma arc or a complex plasma jet. The spray material jetted through the spray material jetting hole is melted at high thermal efficiency, to thereby enhance yield of coating film. Reflection of the spray material by the outer periphery of plasma flame, penetration of the spray material through plasma flame, and scattering of the spray material caused by reflection or penetration, due to the differences in particle diameter, mass, etc. of the spray material is prevented.

13 Claims, 12 Drawing Sheets

(51) Int. Cl.
*H05H 1/44* (2006.01)
*C23C 4/134* (2016.01)

(56) References Cited

U.S. PATENT DOCUMENTS 5,808,270 A * 9/1998 Marantz ..... B05B 7/224 219/121.47
6,861,101 B1 * 3/2005 Kowalsky ..... C23C 4/134 427/446
7,491,907 B2 * 2/2009 Kowalsky ..... C23C 24/04 219/76.1
7,763,823 B2 * 7/2010 Zajchowski ..... B23K 10/027 219/121.45
2003/0049384 A1 * 3/2003 Liu ..... C03C 17/001 427/427
2005/0120957 A1 * 6/2005 Kowalsky ..... C23C 24/04 118/723 E
2005/0252450 A1 * 11/2005 Kowalsky ..... B05B 7/226 118/715
2006/0049149 A1 * 3/2006 Shimazu ..... C23C 4/134 219/121.47
2009/0314202 A1 * 12/2009 Zajchowski ..... B05B 7/226 118/620
2010/0237050 A1 * 9/2010 Zehavi ..... H05H 1/42 219/121.47

FOREIGN PATENT DOCUMENTS

JP 04-055748 2/1992
JP 07-034216 2/1995
JP 7-34216 2/1995
JP H0734216 B2 * 4/1995
JP 8-102397 4/1996
JP 2000-38649 2/2000
JP 2002231498 8/2002
JP 2002-299099 10/2002
JP 2006055708 3/2006
JP 2010043341 2/2010
JP 2010043341 A * 2/2010

* cited by examiner

AXIAL FEED PLASMA SPRAYING DEVICE

BACKGROUND OF THE INVENTION

The present invention relates to an axial feed plasma spraying apparatus.

In conventional plasma spraying apparatuses, a spray material is typically fed into a plasma arc or a plasma jet generated in front of the nozzles, in a direction orthogonal to the plasma (i.e., via an external feeding method). In the feeding method, when the spray material has a small particle size and a small mass, the plasma arc or plasma jet repels the material before the material reaches the center of the plasma. When the spray material has a large particle size and a large mass, the material penetrates the plasma arc or plasma jet. In both cases, the yield of spray coating from the used spray material is problematically poor.

In recent years, demand has arisen for plasma spraying of a suspension material containing sub-micron particles or nano particles, or a liquid material of an organometallic compound. When the aforementioned external feeding method is employed, the yield of spray coating is considerably poor, impeding the use of these materials as spray materials, which is also problematic.

In order to enhance the density and adhesion of spray coating film, the speed of the spray material particles jetted by a plasma spray apparatus must be elevated. However, when the conventional external feeding method is employed, with increasing speed, the plasma arc or plasma jet repels an increased number of spray material particles before the material reaches the center of the plasma. Thus, the conventional feeding method is not suited for high-speed feeding.

One known method for solving the above problems is an axial feed plasma spraying apparatus, which is adapted to feed a spray material into a plasma generation chamber in a nozzle, and jetting of the molten spray material together with a plasma jet through a plasma jet jetting hole (see, for example, Patent Documents 1 and 2).

According to the methods disclosed in Japanese Patent Application Laid-Open (kokai) No. 2002-231498 and Japanese Patent Application Laid-Open (kokai) No. 2010-043341, the spray material is melted in a plasma generation chamber disposed in a nozzle. Therefore, the molten spray material is deposited on the inner wall of the plasma generation chamber, on the tips of the electrodes, or in the plasma jet jetting hole, thereby impeding stable and continuous operation. In addition, the products obtained by such a plasma spraying apparatus sometimes bear non-uniform deposits of such material.

Another problem is considerable wear of a nozzle, which is caused by jetting of a spray material through the nozzle at ultra-high speed, increasing wear of the jetting hole.

Also, the plasma generation chamber remains at high pressure because of the plasma gas fed into the chamber. Thus, when a spray material is fed into the plasma generation chamber, a spray material feeder receives back pressure. This imposes a particular pressure-resistant design on the material feeder.

Japanese Patent Application Laid-Open (kokai) No. Hei 7-034216 discloses a plasma spraying apparatus having a plurality of divided plasma jet jetting holes, which are disposed in parallel, so as to increase the area of the formed coating film. This plasma spraying apparatus also has the same problems as described in relation to the aforementioned known axial feed plasma spraying apparatuses.

Japanese Patent No. 4449645, Japanese Patent Application Laid-Open (kokai) No. Sho 60-129156, and Japanese Patent Publication (kokoku) No. Hei 4-055748 disclose plasma spraying apparatuses each having 2 to 4 cathodes and 2 to 4 counter anode nozzles in which plasma flames (also called plasma jets) provided through the anode nozzles are converged.

However, the plasma spraying apparatuses disclosed in this art still have a problem of considerably low yield of spray coating. The problem is caused by poor contact of the converged plasma flame with the sprayed material due to non-uniform damage of cathode nozzles and anode nozzles occurring during the course of spraying operation and due to lack of flow rate uniformity of working gases. This results in insufficient heat exchange and scattering of the spray material to undesired sections of the apparatuses.

Also, since a plurality of cathodes and anode nozzles are cooled, the apparatuses must be provided with a complex cooling path, leading to considerable energy loss of cooling water. In addition, maintenance of such cooling systems is very cumbersome and requires a long period of time.

SUMMARY OF THE INVENTION

In view of the foregoing, an object of the present invention is to prevent deposition or adhesion of a molten spray material on or to the inner wall of a plasma generation chamber, an electrode, and a plasma jet jetting hole. Another object of the invention is to melt the spray material jetted through the spray material jetting hole at high thermal efficiency, to thereby enhance yield of coating film. Still another object of the invention is to prevent reflection of the spray material by the outer periphery of plasma flame, penetration of the spray material through plasma flame, and scattering of the spray material caused by reflection or penetration, due to the differences in particle diameter, mass, etc. of the spray material.

The present invention provides a plasma torch comprising a cathode, an anode nozzle, plasma gas feeding means, and spray material feeding means, characterized in that the cathode and the anode nozzle form a pair; that the anode nozzle is provided with three or more plasma jet jetting holes which are disposed at specific intervals along a circle centered at the center axis of the nozzle, so as to split a flow of plasma jet or plasma arc; and that a spray material jetting hole is disposed at the front end of the anode nozzle to be located at the center of an area surrounded by the plasma jet jetting holes.

In an embodiment of the present invention, the plasma jet jetting holes are slanted such that flows of plasma jet or plasma arc jetted through the plasma jet jetting holes intersect one another at an intersection point on the center axis of the nozzle in front of the nozzle.

In another embodiment of the present invention, the plasma jet jetting holes are disposed in parallel or generally in parallel to the center axis, such that flows of plasma jet jetted through the plasma jet jetting holes do not intersect at a point on the center axis of the anode nozzle, before the plasma jet or plasma arc reaches a coating substrate.

In another embodiment of the present invention, the plasma generation chamber of the plasma torch is segmented into a front chamber and a rear chamber, each of which is provided with plasma gas feeding means. In another embodiment of the present invention, the plasma gas feeding means is disposed in a tangential direction with respect to the plasma generation chamber, so as to generate a swirl (i.e., helical) flow of the plasma gas fed through the plasma gas feeding means.

In another embodiment of the present invention, a sub plasma torch is disposed in front of the anode nozzle such that the center axis of the sub plasma torch intersects the center axis of the main torch. In another embodiment of the present invention, the sub plasma torch is disposed such that flows of sub plasma jet or sub plasma arc intersect one another at an intersection point of the flow of plasma jet or plasma arc provided by the main torch or at a point in the vicinity of the intersection point.

In another embodiment of the present invention, a plurality of sub plasma torches are provided. In another embodiment of the present invention, the number of the sub plasma torches is identical to that of the plasma jet jetting holes of the main torch. In another embodiment of the present invention, three plasma jet jetting holes are employed, and three sub plasma torches are provided. In another embodiment of the present invention, each flow of plasma arc jetted through each of the plasma jet jetting holes is joined to form a hairpin curved arc respectively with a flow of sub plasma arc achieved by one of the sub plasma torches, which is in the closest vicinity, and flows of hairpin curved arc are independent from one another without intersecting.

In another embodiment of the present invention, the center axis of the sub plasma torch is orthogonal to the center axis of the main plasma jet, or slanted, toward the rear direction, with respect to the center axis of the main plasma jet. In another embodiment of the present invention, an ultra-high-speed nozzle is attached to the front end of the anode nozzle. In another embodiment of the present invention, the spray material feeding means is provided with a plurality of spray material feeding holes. In another embodiment of the present invention, the polarity of the cathode and that of anode are inverted.

The effects of the present invention are as follows.

According to the present invention, a spray material is not directly fed into a plasma generation chamber, but is fed (jetted) to the center of plasma jet or plasma arc in front of the front end of the nozzle. Thus, the molten spray material is not deposited on the interior of the plasma generation chamber, an electrode, and a plasma jet jetting hole. As a result, stable, continuous plasma spraying can be attained, and the products obtained by such a plasma spraying apparatus do not bear such spit-like deposits. In addition, since the plasma generation chamber has no spray material jetting hole, no back pressure is applied to a spray material feeder. Thus, no particular pressure-resistant design is needed for the material feeder, and the service life of the nozzle can be prolonged.

According to the present invention, the plasma jet jetting holes are slanted such that flows of plasma jet or plasma arc intersect one another at an intersection point in front of the nozzle. Thus, the spray material jetted through the spray material jetting hole can be uniformly heated and melted in plasma jet or plasma arc, realizing plasma spraying at high thermal efficiency and high product yield.

According to the present invention, the spray material is fed into the axial center high-temperature space of plasma jet or plasma arc. Thus, there can be prevented reflection of the spray material by the outer periphery of plasma flame, penetration of the spray material through plasma flame, and scattering of the spray material caused by reflection or penetration, due to the differences in particle diameter, mass, etc. of the spray material. As a result, granulation or classification may be omitted in the spray material production step, and thereby a low cost spray material can be used. In addition, not only powdery spray material but also liquid spray material may be used, if required.

According to the present invention, the plasma jet jetting holes are disposed in parallel or generally in parallel to the center axis such that flows of plasma jet jetted through the plasma jet jetting holes do not intersect at a point on the center axis of the anode nozzle, before the plasma jet reaches a coating substrate. Thus, flows of the plasma jet jetted through the plasma jet jetting holes form a cylindrical shape flow targeting the substrate. As a result, the spray material jetted through the spray material jetting hole does not come into direct contact with the plasma jet immediately after jetting of the material, and can flow to the substrate while the material is surrounded by the divided plasma jet flows to minimize contact with air.

DETAILED DESCRIPTION OF THE PREFERRED EMBODIMENT

Embodiment 1

Figure 1:
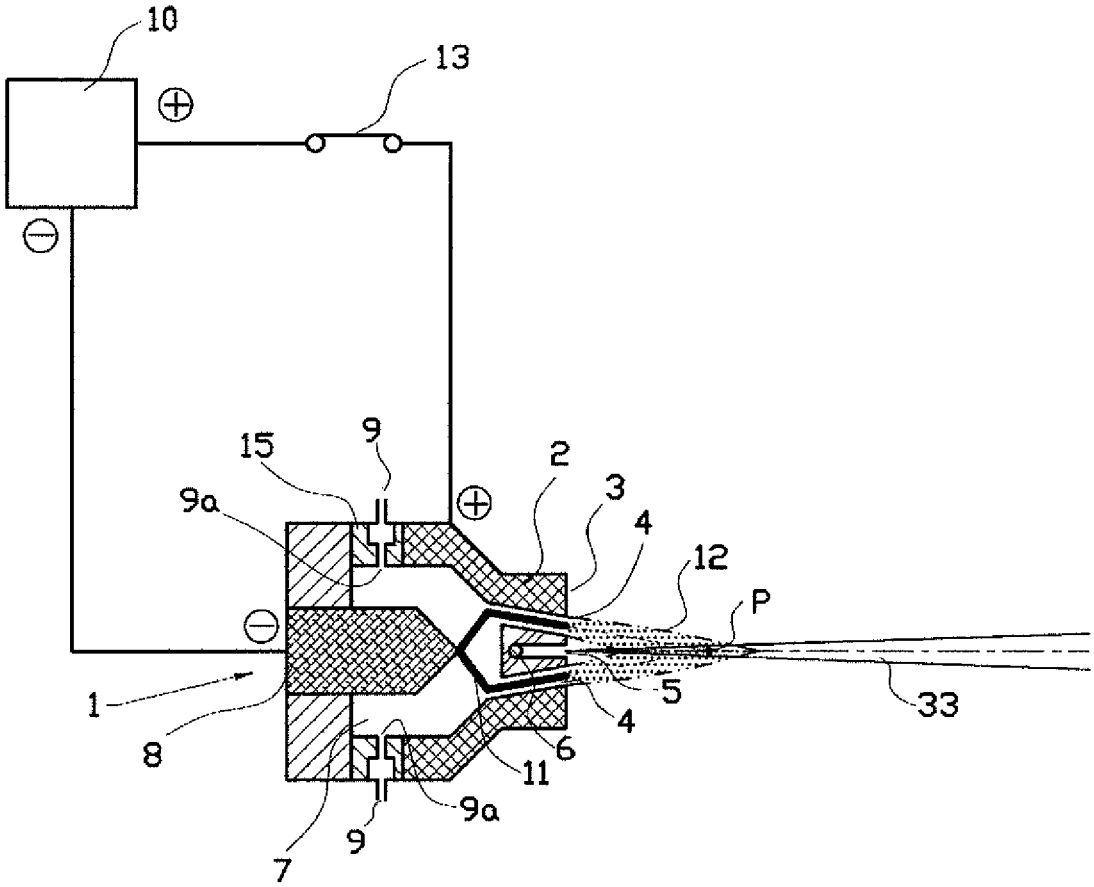
FIG. 1 is a cross-sectional view of a plasma spraying apparatus according to Embodiment 1 of the present invention.

FIG. 1 shows embodiment 1 of the present invention, which is a spraying apparatus called "one-stage-type single torch." In FIG. 1, reference numeral 1 denotes a torch, serving as the axial feed plasma spraying apparatus of the present invention. The torch 1 has a pair of cathode and anode nozzle; i.e., a cathode 8 and an anode nozzle (anode) 2. The cathode 8 is formed in the rear part of the torch 1, and the anode nozzle 2 is formed in the front part thereof.

A front end 3 of the anode nozzle 2 is provided with three plasma jet jetting holes 4 which are disposed at specific intervals along a circle centered at the center axis of the nozzle. The plasma jet jetting holes 4 are angled such that flows of plasma jet 12 jetted through the plasma jet jetting holes 4 intersect one another at an intersection point P on the axis passing the center of the circle.

Reference numeral 5 denotes a spray material jetting hole which is disposed at the center of the circle on which the plasma jet jetting holes 4 are disposed. A spray material is fed to the spray material jetting hole 5 via a spray material feeding hole 6 connected to a spray material feeder (not illustrated).

Reference numeral 7 denotes a plasma generation chamber which is provided in the anode nozzle 2 and to the rear of the plasma jet jetting holes 4. The cathode 8 is disposed at the axial center of the plasma generation chamber 7. When a power switch 13 is closed, a high current/low voltage is applied from a power source 10 to the anode nozzle 2 and the cathode 8, whereby a plasma arc 11 is generated in front of the cathode 8. The plasma arc 11 is branched into said plurality of plasma jet jetting holes 4, and jetted through jetting holes 4, to thereby form flows of plasma jet 12, which intersect at the intersection point P in front of the jetting holes 4.

Reference numeral 9 denotes plasma gas feeding means for feeding a plasma gas (e.g., an inert gas) into the plasma generation chamber 7. In Embodiment 1, jetting holes 9*a* are disposed in a tangential direction with respect to the plasma generation chamber 7, so as to generate a swirl flow in the plasma generation chamber 7, to stabilize the plasma arc 11. Reference numeral 15 denotes an insulation spacer, and 33 indicates the jetting direction of the molten spray material.

In Embodiment 1, three plasma jet jetting holes 4 having the same size are provided. However, the number of the jetting holes is not particularly limited to 3, and a number of 3 to 8 is preferred for practical use. The inclination angle of any of the jetting holes 4 is determined in accordance with the position of P in front of the front end of the nozzle 3. In Embodiment 1, the three jetting holes 4 are disposed along a circle at uniform intervals. However, the intervals may be appropriately modified in accordance with needs.

Embodiment 2

Figure 2:
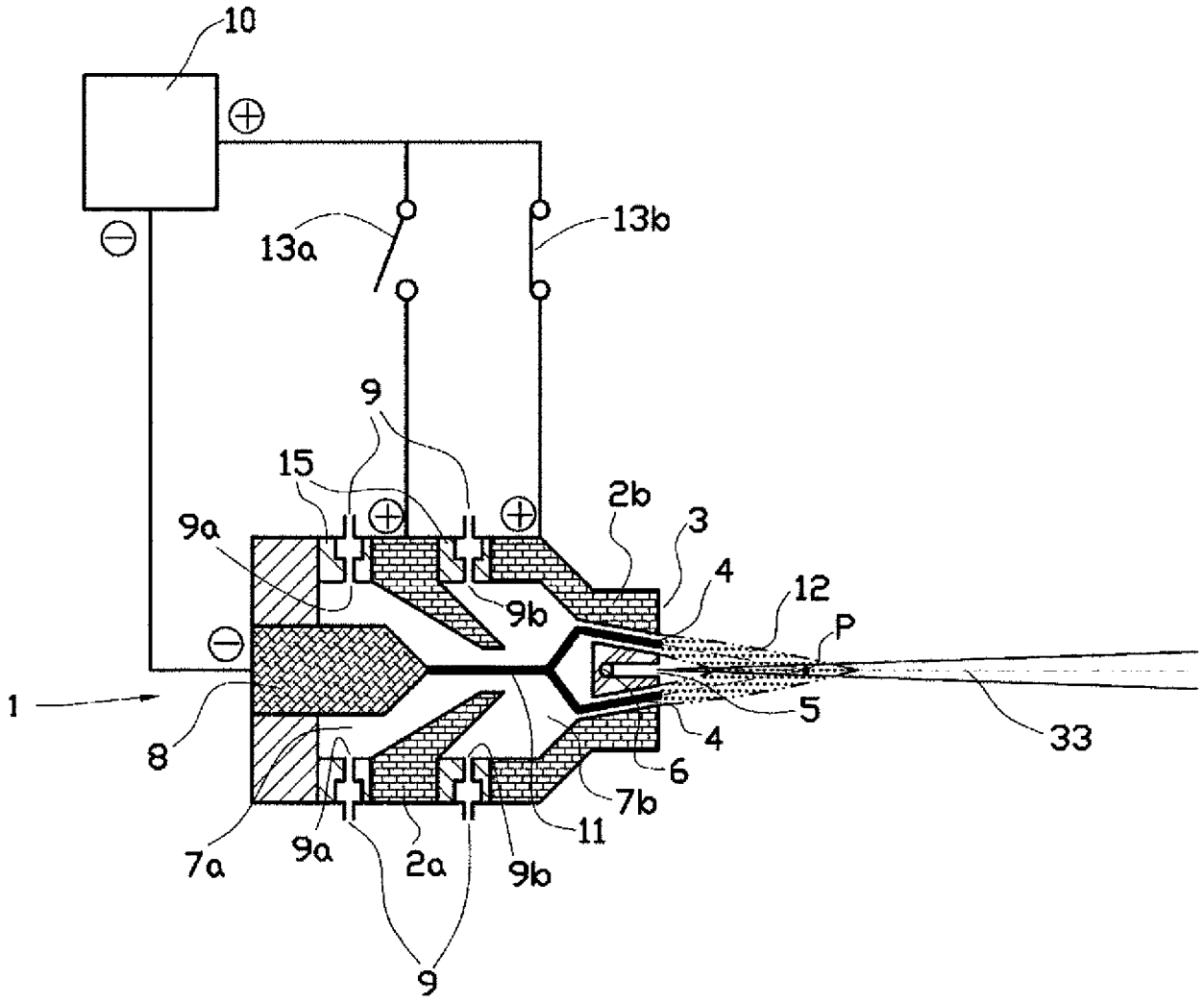
FIG. 2 is a cross-sectional view of a plasma spraying apparatus according to Embodiment 2 of the present invention.

In FIG. 2, members having the same structure and functions as those of the members shown in FIG. 1 are denoted by the same reference numerals, and overlapping descriptions will be omitted. As shown in FIG. 2, in Embodiment 2, a plasma generation chamber 7 provided in the anode nozzle 2 and is segmented into a rear chamber 7*a* and a front chamber 7*b*, except for the axial center portion of the chamber 7. Each of the chambers 7*a*, 7*b* is provided with plasma gas feeding means; i.e., jetting holes 9*a*, 9*b*. A cathode 8 is attached to the rear chamber 7*a*.

Since the plasma generation chamber 7 is segmented into the rear chamber 7*a* and the front chamber 7*b* in Embodiment 2, the output of plasma arc 11 can be enhanced, and inexpensive compressed air, nitrogen, or the like can be used as a plasma gas to be fed to the front chamber 7*b*. In Embodiment 2, the anode nozzle 2 consists of a nozzle portion 2*a* of the rear chamber 7*a* and a nozzle portion 2*b* of the front chamber 7*b*. Switches 13*a* and 13*b* selectively couple the power supply 10 between the anode sections 2*a* and 2*b* and the cathode 8.

Embodiment 3

Figure 3:
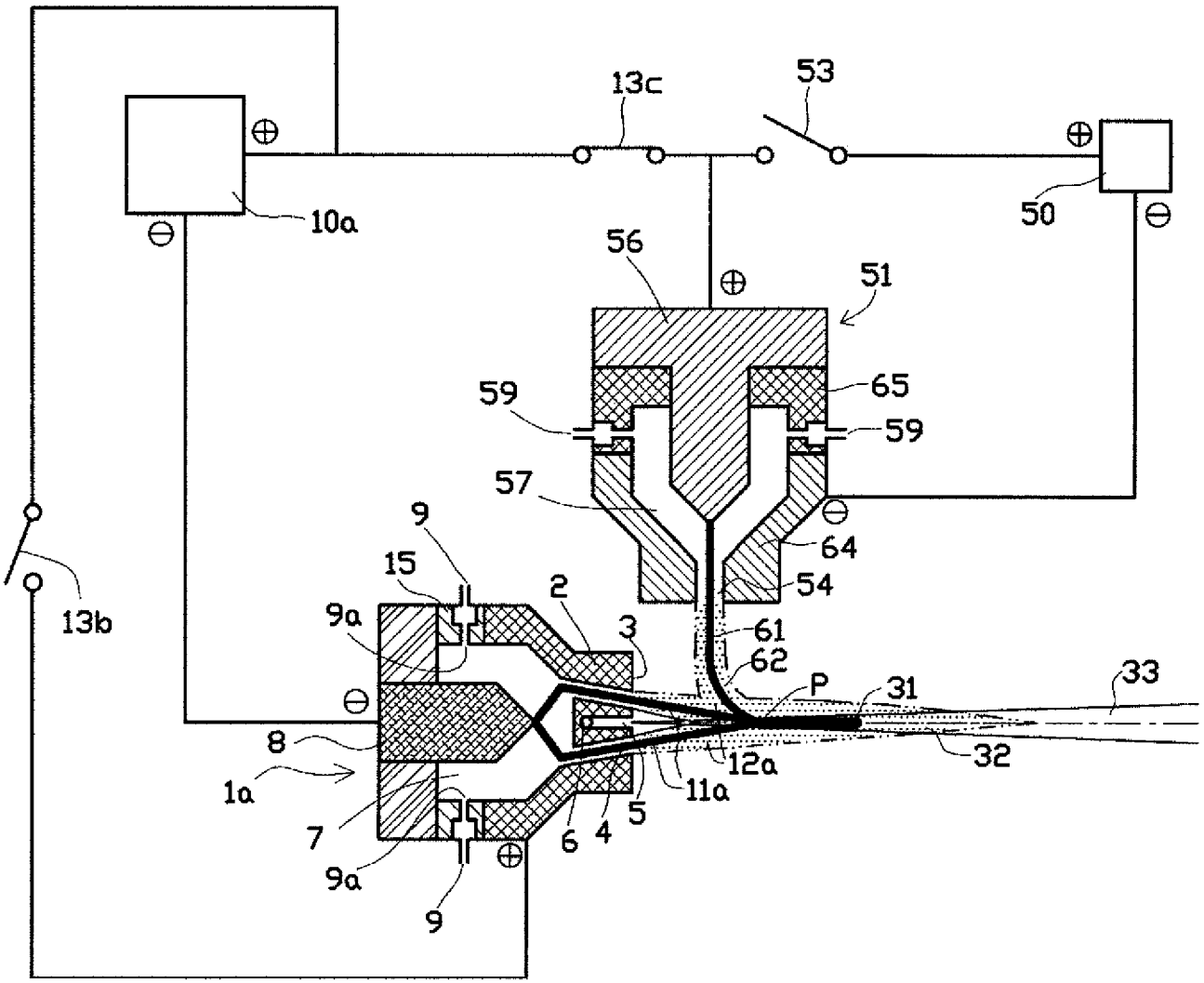
FIG. 3 is a cross-sectional view of a plasma spraying apparatus according to Embodiment 3 of the present invention.

In FIG. 3, members having the same structure and functions as those of the members shown in FIG. 1 are denoted by the same reference numerals, and overlapping descriptions will be omitted. As shown in FIG. 3, Embodiment 3 is a complex torch comprising the torch 1 as described in Embodiment 1, and a sub plasma torch 51 disposed in front of the torch 1, such that the flow of sub plasma jet 62, in the direction orthogonal to the main plasma jet flow, intermingles with the main plasma jet 12*a* at the intersection point P (hereinafter, the sub plasma torch may be referred to simply as "sub torch"). A nozzle 64 of the sub torch 51 serves as a cathode, and a sub torch electrode 56 serves as an anode. Through provision of the sub torch 51, a complex plasma arc 31 can be formed, at the intersection point P or a point in front of P. The Complex plasma arc 31 includes the main plasma arc 11*a* provided by the main plasma torch 1*a* (hereinafter may be referred to simply as "main torch") and a sub plasma arc 61 provided by sub torch 51.

In Embodiment 3, the sub torch 51 is disposed so as to be orthogonal to the intersection point P. However, the sub torch 51 may be slightly slanted toward the rear direction. Most preferably, the sub plasma arc 61 jetted through the sub torch 51 intermingles with the main plasma arc 11*a* at the intersection point P, but the intermingle point may be slightly shifted to the left or right of point P as viewed in FIG. 3.

The sub torch 51 has no spray material feeding means and has only one sub plasma jet jetting hole 54 at the axial center.

By means of the complex torch, the sub plasma arc 61 formed by the sub torch 51 is added to the main plasma arc 11*a* formed in front of the anode nozzle 2 of the main torch 1*a*, to thereby form the complex plasma arc 31. In this case, since a spray material can be directly fed to the axial center of the complex plasma arc 31, the material remains at the center of the plasma arc 31 for a longer period of time, thereby elevating melting performance.

In FIG. 3 showing Embodiment 3, reference numerals 13*b*, 13*c* denote switches coupling power supply 10*a* to anodes 2 and 56. Reference numeral 32 is a complex plasma jet, reference numeral 50 is a sub power source coupled by switches 53 between anode 56 and cathode 64 of sub torch 51. Reference numeral 57 is a plasma generation chamber, while reference numeral 59 is a plasma gas feeding means, and reference numeral 65 is an insulation spacer.

Embodiment 4

Figure 4:
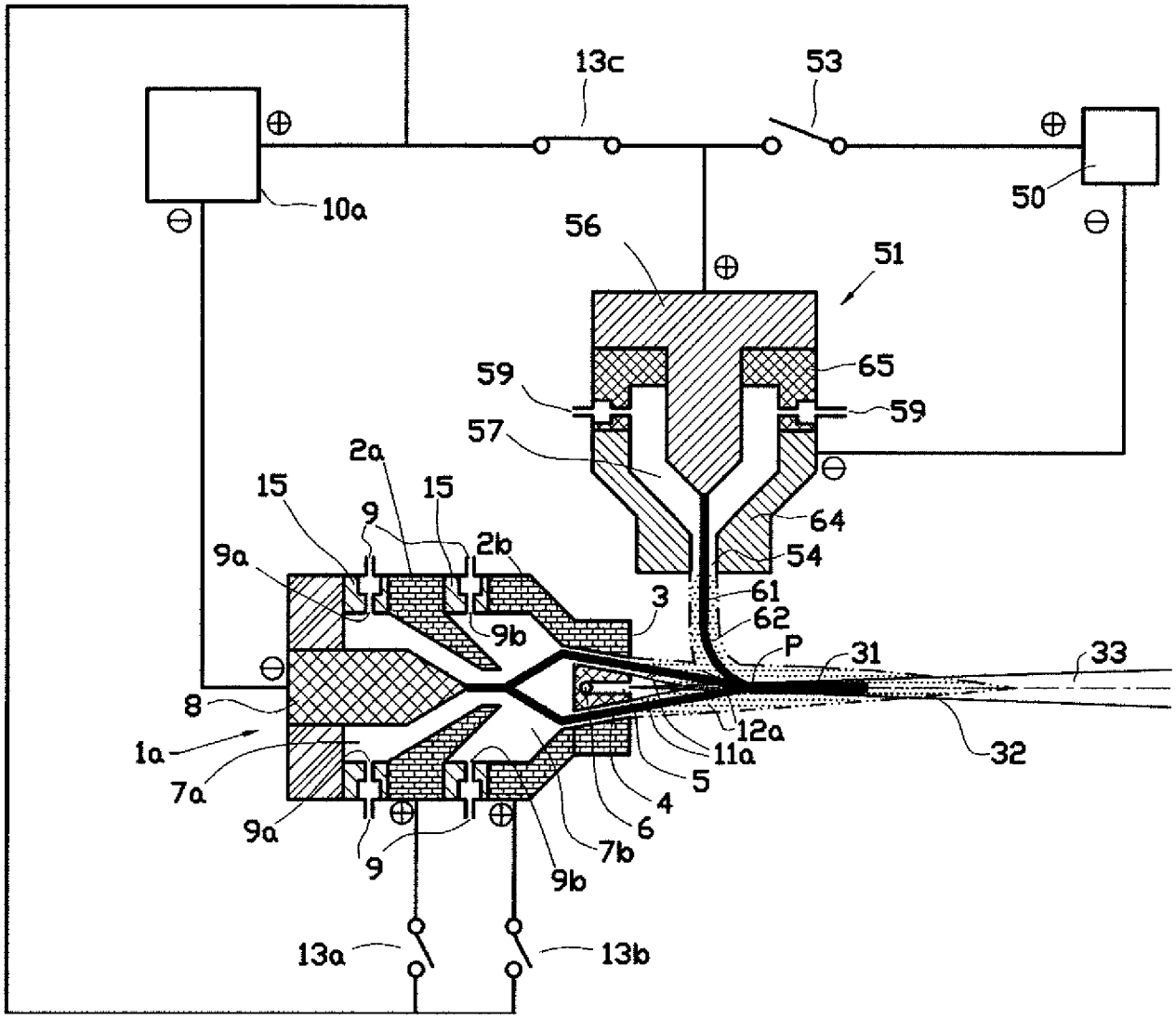
FIG. 4 is a cross-sectional view of a plasma spraying apparatus according to Embodiment 4 of the present invention.

In FIG. 4, members having the same structure and functions as those of the members shown in FIGS. 1 to 3 are denoted by the same reference numerals, and overlapping descriptions will be omitted. Embodiment 4 is a complex torch having the two-stage-type single torch described in Embodiment 2 in combination with the sub torch 51 described in Embodiment 3, for attaining the surprising and unexpected synergistic effects obtained from utilizing Embodiments 2 and 3.

OPERATION EXAMPLES

Operation Examples of the aforementioned Embodiments 1 to 4 are as follows.

(1) Operation Example of Embodiment 1

FIG. 1, one-stage-type, single torch
Spray coating film: ceramic spray coating film
Current, voltage, output: 800 A×90 V=72 kW
Gas species, gas flow rate: argon (25 L/min), hydrogen (60 L/min)

(2) Operation Example of Embodiment 2

FIG. 2, two-stage-type, single torch
Spray coating film: ceramic spray coating film
Current, voltage, output: 480 A×150 V=72 kW
Gas species, gas flow rate: argon (25 L/min), hydrogen (60 L/min)

(3) Operation Example of Embodiment 3

FIG. 3, one-stage-type, complex torch including sub torch
Spray coating film: ceramic spray coating film
Current, voltage, output: 360 A×200 V=72 kW
Gas species, gas flow rate: argon (80 L/min)

(4) Operation Example of Embodiment 4

FIG. 4, two-stage-type, complex torch including sub torch
Spray coating film: ceramic spray coating film
Current, voltage, output: 240 A×300 V=72 kW
Gas species, gas flow rate: argon (25 L/min), compressed air (75 L/min)

Embodiment 5

Embodiment 5 is a complex torch similar to that of Embodiment 4 having one sub torch 51, but the complex torch of Embodiment 5 has three sub torches 51, arranged as shown in FIGS. 5 to 8. Embodiment 5 contemplates a linear and stable flow of plasma arc or plasma jet. In FIGS. 5 to 8, members having the same structure and functions as those of the members shown in FIG. 4 are denoted by the same reference numerals, and overlapping detailed descriptions will be omitted. In FIGS. 5, 10A, 10B, and 10C each denote a transistor power source, and $S_1$, $S_2$, and $S_3$ each denote a switch.

The complex torch of Embodiment 5 has an anode nozzle 2*b* provided with three plasma jet jetting holes 4 in a circumferential direction with uniform intervals. The number of the jetting holes 4 (FIG. 6) and the interval between the holes may be appropriately modified in accordance with needs.

Figure 5:
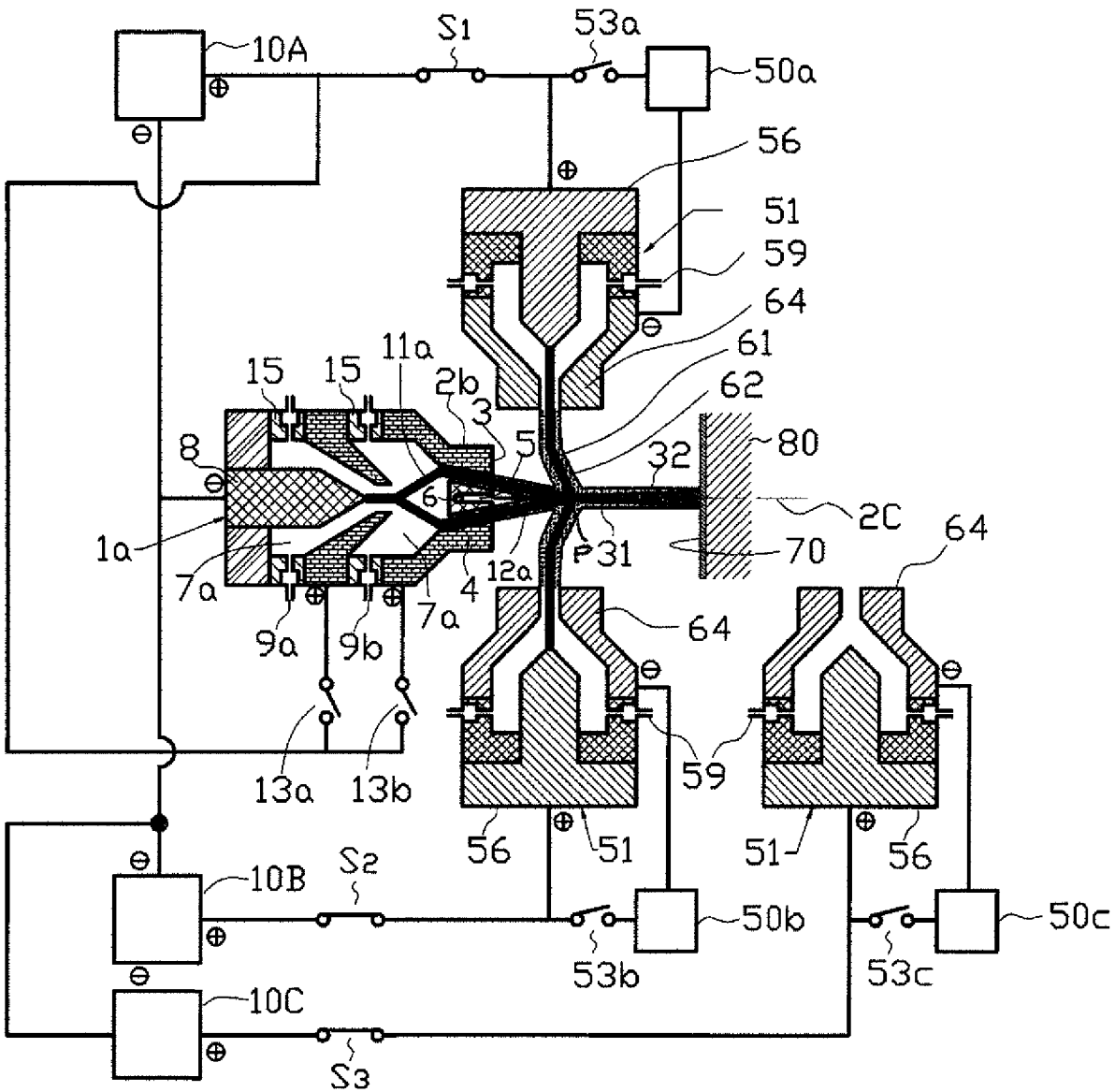
FIG. 5 is a cross-sectional view of a plasma spraying apparatus according to Embodiment 5 of the present invention.
Figure 8:
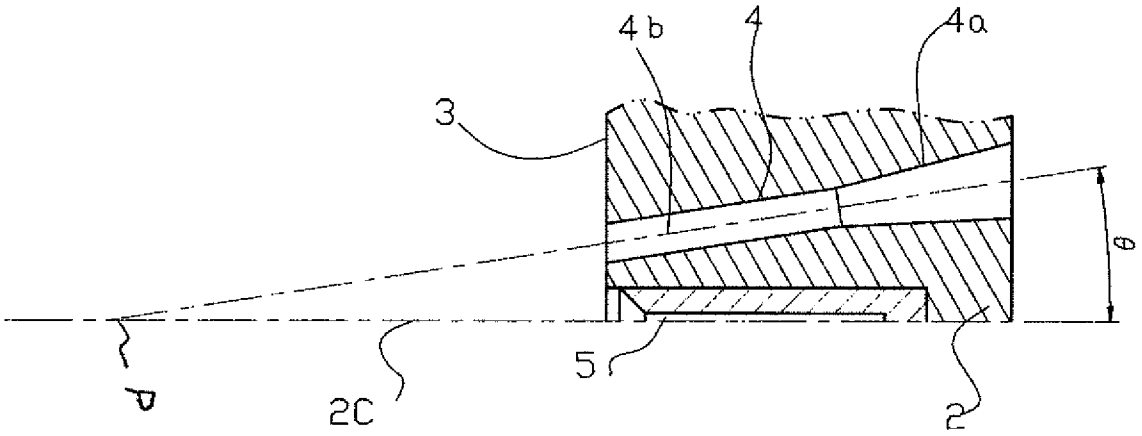
FIG. 8 is an enlarged cross-sectional view of a plasma jet jetting hole of the anode nozzle FIG. 5.

As shown in FIG. 8, each jetting hole 4 is slanted by an angle θ with respect to the center axis 2C of the anode nozzle 2. The inclination angle θ is appropriately modified in accordance with needs, and is adjusted to, for example, from about 4° to about 6°. The jetting hole 4 consists of an inlet 4*a* of an inverted frustum shape, and a straight tube outlet 4*b* connected to the inlet 4*a*. The main plasma arc 11*a* and the main plasma jet 12*a* can readily enter the jetting hole 4. The spray material jetting hole 5 is provided with one spray material feeding hole 6 (FIG. 5). However, a plurality of feeding holes 6 may be provided in accordance with needs. In one possible mode, a pair of feeding holes 6 are centrosymmetrically disposed, and different spray materials may be fed through the respective feeding holes 6, followed by mixing the materials.

Figure 7:
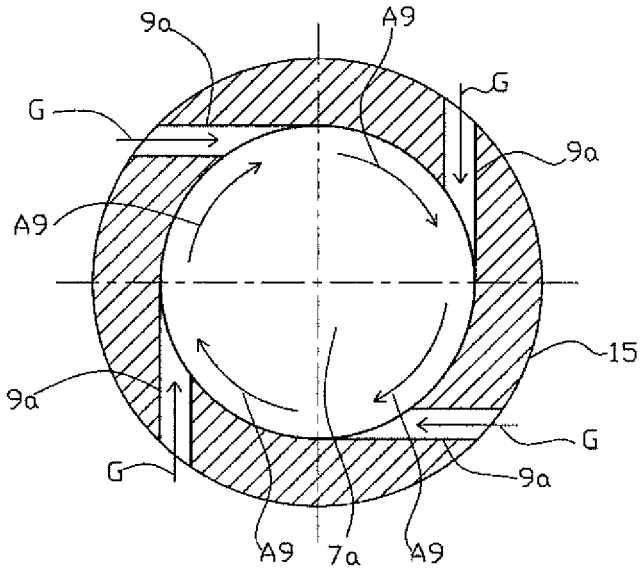
FIG. 7 is an enlarged cross-sectional view of a jetting hole serving as plasma gas feeding means of the main torch of FIG. 5.

As shown in FIG. 7, the main torch 1*a* is provided with a plurality of jetting holes 9*a*. Each jetting hole is disposed in a tangential direction with respect to the plasma generation chamber 7*a*. Therefore, the plasma gas G fed through one jetting hole 9*a* is guided along the inner wall of the plasma generation chamber 7*a* in a direction denoted by arrows A9, to thereby form a swirl flow. In a similar manner, the plasma gas fed through another jetting hole 9*b* into the plasma generation chamber 7*b* forms a swirl flow. The swirl flow is divided into respective plasma jet jetting holes 4. In each jetting hole 4, the plasma gas flows with a swirling action and is jetted to the intersection point P (FIGS. 5 and 8).

Figure 6:
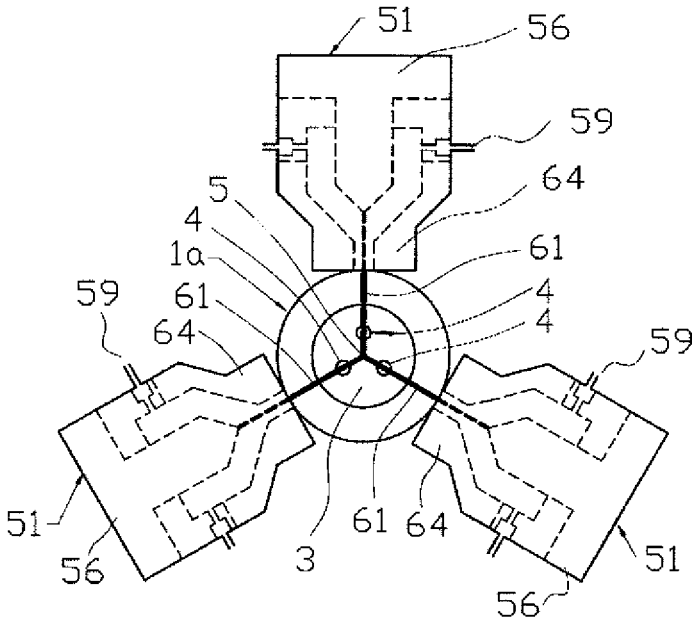
FIG. 6 is a side elevational view of the torch of Embodiment 5.

Sub plasma torches 51 are provided three in number, that number corresponding to the number of the plasma jet jetting holes 4 of the main plasma torch 1*a*. The sub torches 51 are disposed in a circumferential direction with respect to the center axis of the main torch at uniform intervals, as seen in FIG. 6, such that the center axis of the main torch 1*a* intersects the center axis of each sub torch 51. Each sub torch 51 generates a sub plasma arc 61 by closing the switches 53*a*, 53*b*, or 53*c* (on state). The sub plasma arc 61 is joined to form arc of a hairpin shape (so-called hairpin arc) with a flow of the plasma arc 11*a* of the main torch 1*a* present at the closest vicinity of each sub plasma torch. As a result, a conduction path is formed from the tip of the cathode 8 of the main torch 1*a* to the anode tip of a sub torch electrode 56 of the sub torch 51. The switches 53*a*, 53*b*, and 53*c* are opened after the formation of the hairpin arc (off state).

The spray material fed through the spray material feeding hole 6 is jetted through the spray material jetting hole 5 to the aforementioned intersection point P. While the material is melted at high temperature, it flows while being surrounded by flows of the main plasma jet 12*a* (FIG. 5). The particles of the molten spray material; i.e., melt particles, collide with a substrate (coating substrate) 80, to thereby form a spray coating film 70. In this case, since three flows of the hairpin arc are converged at the intersection point P, the complex plasma arc 31 or the complex plasma jet 32 can be more stabilized, as compared with the case where one sub torch is employed (Embodiment 4).

Embodiment 6

Figure 9:
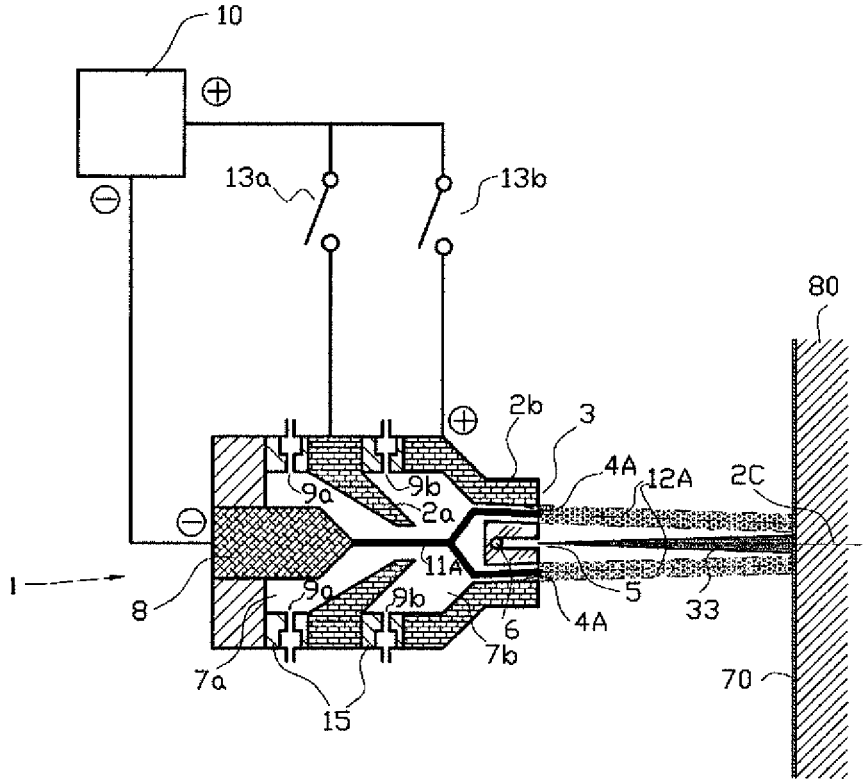
FIG. 9 is a cross-sectional view of a plasma spraying apparatus according to Embodiment 6 of the present invention.
Figure 10:
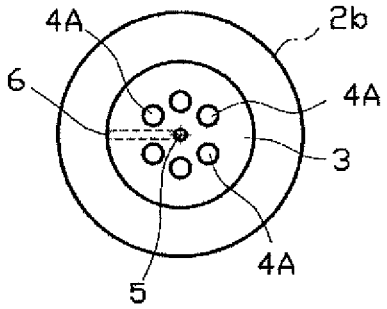
FIG. 10 is a right side elevational view of the plasma spraying apparatus of Embodiment 6.

Embodiment 6 is shown in FIGS. 9 and 10. In FIGS. 9 and 10, members having the same structure and functions as those of the members shown in FIG. 2 are denoted by the same reference numerals, and overlapping detailed descriptions will be omitted.

This embodiment is a single torch similar to that of Embodiment 2 (FIG. 2), but the plasma jet jetting holes 4 are disposed in parallel or generally in parallel (slightly slanted) to the center axis, as shown in FIGS. 9, 10. Embodiment 6 contemplates prevention of intermingling the flows of plasma jet 12A jetted through the plasma jet jetting holes 4A at an intersection point on the center axis 2C of the anode nozzles 2*a*, 2*b* of the torch 1, before the plasma jet 12A reaches a coating substrate 80. The center axis (center axis line) 2C of the anode nozzles 2*a*, 2*b* coincides with the center axis (center axis line) of the main torch 1*a*.

As shown in FIG. 10, six plasma jet jetting holes 4A are disposed (on an imaginary circle) in a circular pattern at specific equal angular intervals so as to surround the spray material jetting hole 5. The number and intervals of disposition of the jetting holes 4A may be appropriately chosen in accordance with needs. For example, 4 jetting holes 4A with uniform intervals may be employed.

The aforementioned plasma jet jetting holes 4A are disposed in parallel to the center axis 2C of the anode nozzles 2*a*, 2*b*. However, the holes are not necessarily disposed in parallel, and may be disposed generally in parallel. Specifically, the jetting holes 4A are disposed with a small inclination angle such that flows of plasma jet 12A jetted through the jetting holes 4A do not intersect at a point on the center axis 2C of the anode nozzles 2*a*, 2*b*, before the plasma jet 12A reaches a coating substrate 80. Such a small inclination angle is, for example, +2° to −2°, so that the plasma jetting holes 4A are disposed generally in parallel to the center axis 2C of the anode nozzles 2*a*, 2*b*.

In Embodiment 6, the spray material jetted through the spray material jetting hole 5 is melted by the plasma jet 12A, and the formed melt particles collide with the substrate 80, to thereby form a spray coating film 70. In Embodiment 6, the spray material jetting hole 5 is disposed at the center of an imaginary circle (center axis) on which the plasma jet jetting holes 4 are present, and the plasma jet jetting holes 4A are disposed on the circle at specific intervals. Thus, flows of the plasma jet 12A jetted through the plasma jet jetting holes 4A form a cylindrical shape flow targeting the substrate 80.

The spray material jetted through the spray material jetting hole 5 goes straight to the substrate 80, while being surrounded by the cylindrical plasma jet. Thus, the spray material does not come into direct contact with the plasma jet immediately after jetting of the material, and can flow to the substrate while the material is surrounded by flows of the divided plasma jet 12A, to thereby minimize contact with air. As a result, a spray coating film of interest can be formed, even when there is used a spray material which melts with low heat due to low melting point or a small particle size. A spray coating film of interest can be formed, even when a spray material which is deteriorated in function by oxidation or transformation, due to high heat for melting, or which sublimates, and otherwise would fail to form a spray-coating film.

Embodiment 7

Figure 11:
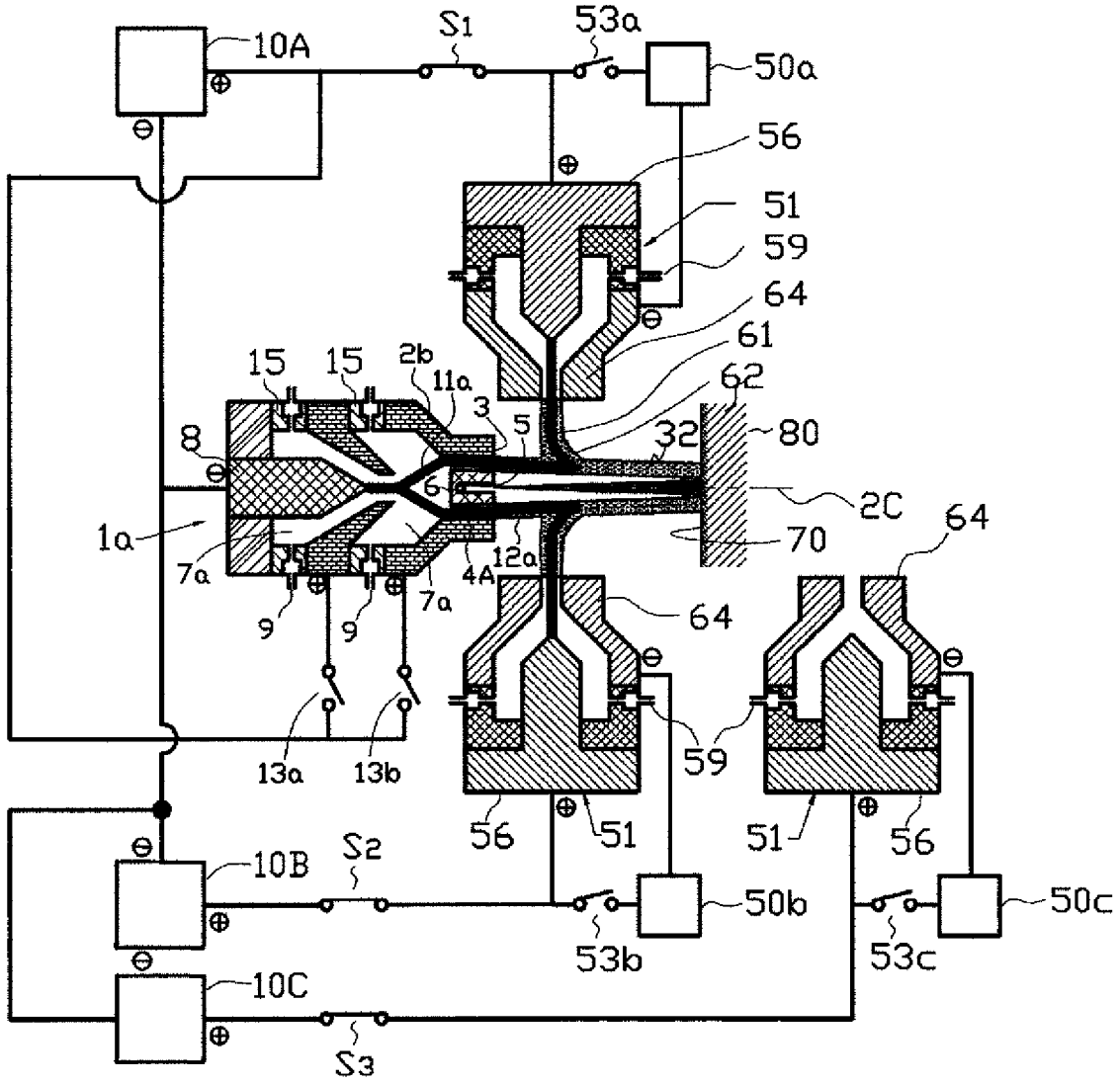
FIG. 11 is a vertical cross-sectional view of a plasma spraying apparatus according to Embodiment 7 of the present invention.
Figure 12:
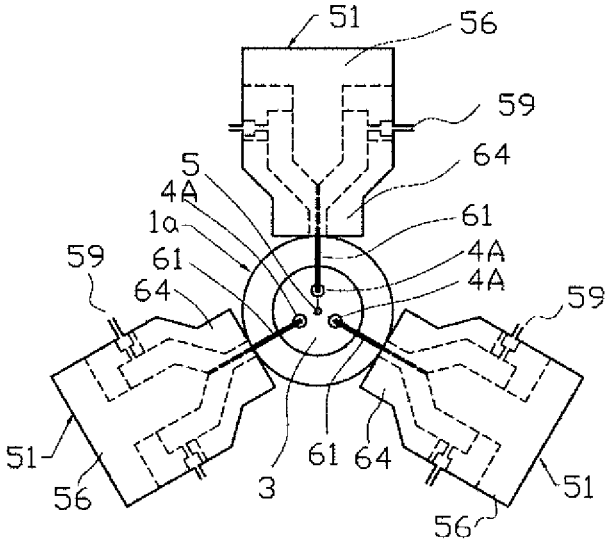
FIG. 12 is a side view of a complex torch of FIG. 11.

Embodiment 7 is shown in FIGS. 11 and 12. In FIGS. 11 and 12, members having the same structure and functions as those of the members shown in FIGS. 5 to 10 are denoted by the same reference numerals, and overlapping detailed descriptions will be omitted.

This embodiment is a complex torch similar to that of Embodiment 5 (FIGS. 5 to 8), but the plasma jet jetting holes are disposed in parallel or generally in parallel (slightly slanted) to the center axis, as shown in FIGS. 11, 12 (similar to Embodiment 6 (FIGS. 9, 10)). Embodiment 7 contemplates prevention of intermingling the flows of plasma arc 11*a* or plasma jet 12*a* jetted through the plasma jet jetting holes 4A at an intersection point on the center axis 2C of the anode nozzles 2*a*, 2*b* of the torch 1*a*, before the plasma arc 11*a* and plasma jet 12 reaches a coating substrate 80.

As shown in FIG. 12, three plasma jet jetting holes 4A of the main torch 1*a* are provided at uniform intervals in a circumferential direction with respect to the center axis of the main torch. These jetting holes 4A are formed in the same manner as employed in Embodiment 6. Sub plasma torches 51 are provided three in number, that number corresponds to the number of the letting holes 4A of the main plasma torch 1*a*.

In Embodiment 7, flows of sub plasma arc 61 provided by the sub torches 51 are joined to the main plasma arc 11*a* jetted through the plasma jet jetting holes 4A at the closest vicinity of the sub torches, to form a hairpin arc. As a result, a conduction path is formed from the tip of the cathode 8 of the main torch 1*a* to the anode tip of a sub torch electrode 56 of each sub torch 51.

In this way, three hairpin arc flows are individually generated so that the flows of main plasma arc 11*a* jetted through the plasma jet jetting holes 4A do not intersect one another. Also, flows of plasma jet 12*a* jetted through the jetting holes 4A do not intersect one another before the plasma jet collides with a coating substrate 80.

In Embodiment 7, the spray material fed through the spray material feeding hole 6 does not enter directly to the main plasma jet 12*a* or the main plasma arc 11*a*. In addition, contact of the spray material with air is inhibited, since the material is surrounded by the space defined by the main plasma jet 12*a* and the main plasma arc 11*a*. By virtue of the characteristic features, the same effects as those of Embodiment 6 can be attained.

Embodiment 8

Figure 13:
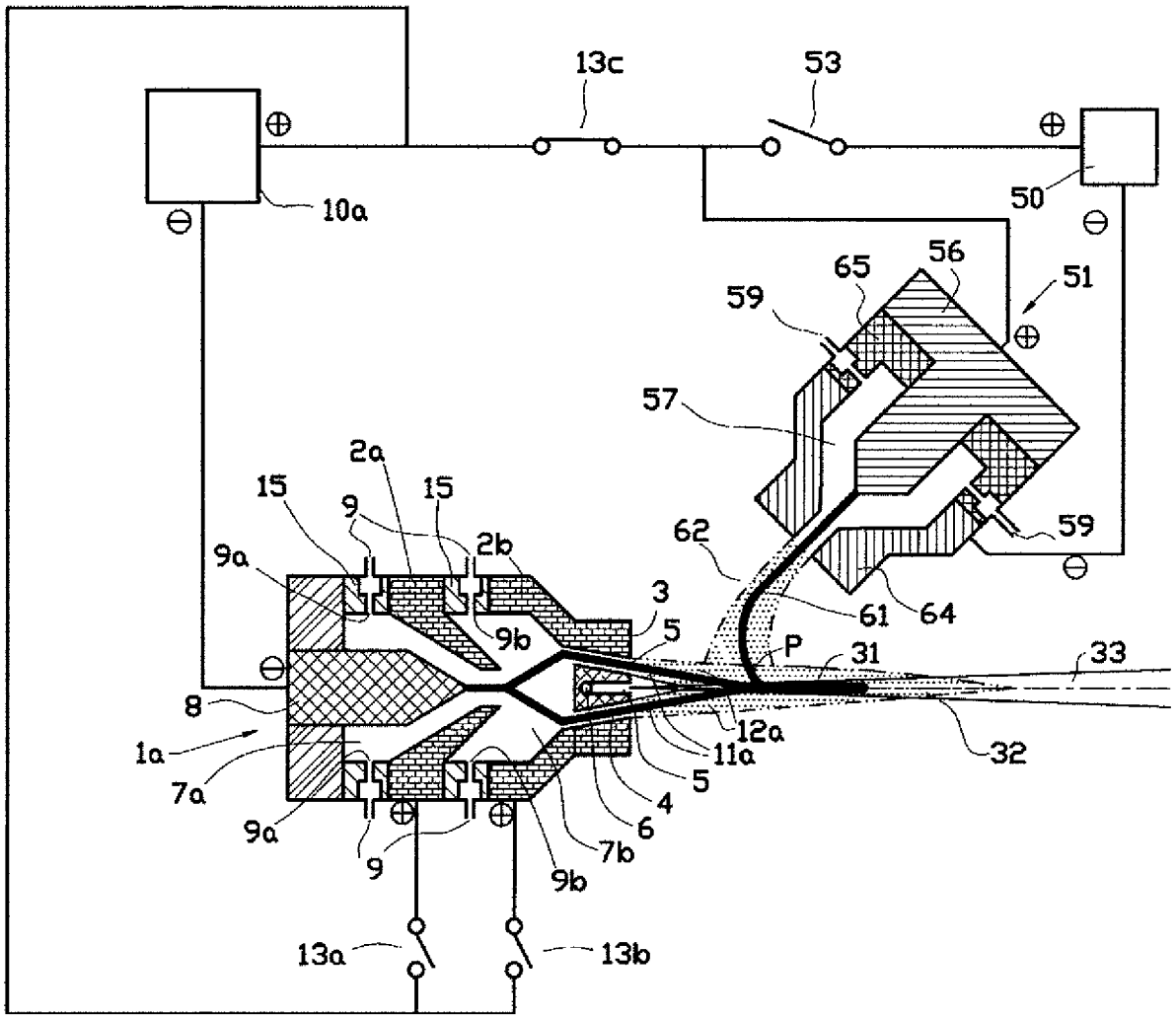
FIG. 13 is a vertical cross-sectional view of a plasma spraying apparatus according to Embodiment 8 of the present invention.

Embodiment 8 is shown in FIG. 13. In FIG. 13, members having the same structure and functions as those of the members shown in FIG. 4 are denoted by the same reference numerals, and overlapping detailed descriptions will be omitted. In this embodiment, a complex torch similar to that of Embodiment 4 (FIG. 4), but the sub torch 51 torch is slanted toward the rear direction, with respect to the center axis of the main plasma jet, as shown in FIG. 13. Embodiment 8 contemplates a linear and stable flow of plasma arc or plasma jet.

In Embodiment 8, the sub torch 51 is slanted in the rear direction with respect to the intersection point P. That is, the sub torch 51 is slanted in such a direction that the sub torch electrode 56 is apart from the main torch 1*a*. The inclination angle; i.e., the angle between the center axis of the main torch 1*a* and the center axis of the sub torch 51, is 45°. The inclination angle may be appropriately modified and is selected from a range, for example, of from about 35° to about 55°. Needless to say, this feature of Embodiment 8 may be applied to Embodiment 3 (FIG. 3) and other embodiments.

Embodiment 9

Figure 14:
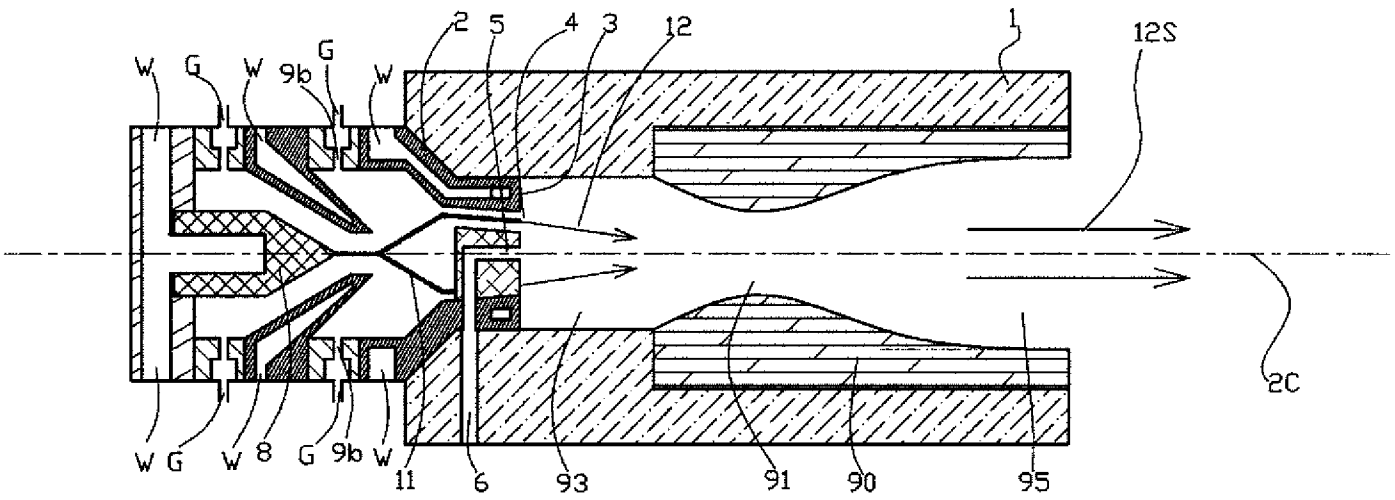
FIG. 14 is a vertical cross-sectional view of a plasma spraying apparatus according to Embodiment 9 of the present invention.

Embodiment 9 is a single torch similar to that of Embodiment 2, but an ultra-high-speed nozzle 90 is attached to the front end 3 of the anode nozzle 2, as shown in FIG. 14. Embodiment 9 contemplates production of ultra-high-speed plasma jet. In FIG. 14, members having the same structure and functions as those of the members shown in FIG. 2 are denoted by the same reference numerals, and overlapping detailed descriptions will be omitted.

The ultra-high-speed nozzle 90 of Embodiment 9 consists of an upstream funnel-like section 93, which opens and widens radially toward the inlet of a drawn section 91; and an downstream funnel-like section 95, which opens and widens radially toward the outlet of the drawn section 91. The upstream funnel-like section 93 has a length in the axial direction almost the same as that of the downstream funnel-like section 95. The opening size of the downstream funnel-like section 95 is greater. In FIG. 14, reference numeral W denotes a cooling medium supplied to a cooling section, and 12S denotes a supersonic plasma jet.

In Embodiment 9, the plasma jet 12 jetted through the plasma jet jetting holes 4 is transferred to the upstream funnel-like section 93 and narrowed in the drawn section 91. When the narrowed plasma jet 12 is released to the downstream funnel-like section 95, whereby the plasma jet rapidly expands, thereby generating an ultrasonic speed plasma jet 12S. As a result, the flying speed of the particles of the molten spray material can elevated to a supersonic speed; for example, a speed 3 to 5 times the speed of sound. Thus, a high-performance spray coating film having higher density and high adhesion can be formed.

Needless to say, the high-speed nozzle of Embodiment 9 may also be employed in Embodiment 1 and other embodiments.

The present invention is not limited to the aforementioned Embodiments, and the following embodiments also fall within the scope of the present invention.

(1) The polarity of the cathode and that of the anode employed in each of the single torches and complex torches of the above Embodiments may be inverted. Specifically, the polarity of the cathode 8 and that of the anode nozzle 2 of the single torch, the cathode 8 and that of the anode nozzle 2 of the main torch of the complex torch, or the sub torch electrode 56 and the nozzle 64 of the sub torch may be inverted, respectively.

(2) In the above Embodiments, three plasma jet jetting holes 4 are provided on the front end 3 of the anode nozzle 2 of the above Embodiments such that the three holes are disposed on a single imaginary circle at specific intervals. Alternatively, a plurality of plasma jet jetting holes 4 may be provided such that the holes are disposed at specific intervals on a plurality of (two or more) concentric imaginary circles present at specific intervals. Through employment of the alternative feature, plasma flame assumes a ring-like form, and air entering into the plasma flame can be prevented. In the above case, the jetting holes 4 are arranged in a houndstooth pattern. However, the disposition pattern may be appropriately modified in accordance with needs.

The present invention is widely employed in industry, particularly in surface modification treatment. The present invention is applicable to a variety of uses such as liquid crystal/semiconductor producing parts, electrostatic chucks, printing film rollers, aircraft turbine blades, jigs for firing, a power generation element for solar cells, fuel cell electrolytes, as examples.

DESCRIPTION OF REFERENCE NUMERALS

1 torch
1*a* main torch
2 anode nozzle
4 plasma jet jetting hole
5 spray material jetting hole
7 plasma generation chamber
8 cathode
9 plasma gas feeding means
11 plasma arc
12 plasma jet
31 complex plasma arc
32 complex plasma jet
51 sub torch
56 sub torch electrode
64 nozzle It will become apparent to those skilled in the art that various modifications to the preferred embodiment of the invention as described herein can be made without departing from the spirit or scope of the invention as defined by the appended claims.

The invention claimed is:

1. An axial feed plasma spraying apparatus serving as a main plasma torch and comprising:

plasma gas feeding means;

spray material feeding means;

a single cathode; and an anode nozzle provided with three or more plasma jet jetting holes located at specific intervals in a circular pattern centered at a center axis of the anode nozzle, so as to split a plasma arc generated in front of the single cathode, the plasma arc branching into the plasma jet jetting holes and jetted therethrough to form flows of plasma jet, wherein the single cathode is axially aligned with the center axis of the circular pattern of plasma jet jetting holes, and wherein a spray material fed by the spray material feeding means is melted by the flows of plasma jet, and further comprising a spray material jetting hole at the front end of the anode nozzle located at the center of an area surrounded by the plasma jet jetting holes.

2. The axial feed plasma spraying apparatus according to claim 1, wherein the plasma jet jetting holes are slanted such that flows of plasma jet jetted through the plasma jet jetting holes intersect one another at an intersection point on the center axis of the anode nozzle in front of the anode nozzle.

3. The axial feed plasma spraying apparatus according to claim 1, wherein the plasma jet jetting holes are in parallel to the center axis such that flows of plasma jet jetted through the plasma jet jetting holes do not intersect at a point on the center axis of the anode nozzle before the plasma jet reaches a coating substrate.

4. The axial feed plasma spraying apparatus according to claim 1, further comprising a plasma generation chamber segmented into a front chamber and a rear chamber, each of which is provided with a plasma gas feeding source.

5. The axial feed plasma spraying apparatus according to claim 4, wherein the plasma gas feeding source is in a tangential direction with respect to the plasma generation chamber, so as to generate a swirl flow of the plasma gas fed through the plasma gas feeding source.

6. The axial feed plasma spraying apparatus according to claim 1, further comprising a sub plasma torch disposed in front of the anode nozzle such that the center axis of the sub plasma torch intersects the center axis of the main plasma torch.

7. The axial feed plasma spraying apparatus according to claim 6, further comprising a plurality of sub plasma torches arranged such that the axis of flow of plasma jets from the sub plasma torches intersect the flows of plasma jet of the main plasma torch.

8. The axial feed plasma spraying apparatus according to claim 7, wherein the number of sub plasma torches is identical to that of the plasma jet jetting holes of the main plasma torch.

9. The axial feed plasma spraying apparatus according to claim 8, wherein the number of the plasma jet jetting holes is three and the number of the sub plasma torches is three.

10. The axial feed plasma spraying apparatus according to claim 8, wherein each of the plasma arc jetted through each of the plasma jet jetting holes is joined to form a hairpin arc respectively with a flow of sub plasma arc achieved by one of the sub plasma torches, which is in the closest vicinity, and wherein respective flows of hairpin arc are independent from one another without intersecting.

11. The axial feed plasma spraying apparatus according to claim 10, wherein the center axis of the sub plasma torch is orthogonal to the center axis of the main plasma torch, or slanted, toward the rear direction, with respect to the center axis of the main plasma torch.

12. The axial feed plasma spraying apparatus according to claim 1, further comprising an ultra-high-speed nozzle attached to the front end of the anode nozzle.

13. The axial feed plasma spraying apparatus according to claim 1, wherein the polarity of the cathode and anode are inverted.

* * * * *